United States Patent [19]

Gray, III

[11] Patent Number: 4,987,401

[45] Date of Patent: Jan. 22, 1991

[54] DIGITAL LOGIC WINDOW PANEL

[76] Inventor: William R. Gray, III, 308 Fireside Dr., Columbia, S.C. 29210

[21] Appl. No.: 319,163

[22] Filed: Mar. 6, 1989

[51] Int. Cl.[5] ..... G08B 5/00

[52] U.S. Cl. ..... 340/332; 340/461; 340/462; 340/762; 340/782; 340/815.01; 340/815.03; 340/815.12

[58] Field of Search ..... 340/461, 462, 525, 815.01, 340/815.03, 762, 782, 332, 286 M, 815.12–815.2; 362/800

[56] References Cited

U.S. PATENT DOCUMENTS

| | | | |
|---|---|---|---|
| 3,796,951 | 3/1974 | Joseph | 340/815.03 |
| 3,813,664 | 5/1974 | Geyer | 340/815.03 |
| 4,072,273 | 2/1978 | Dupree et al. | 346/34 |
| 4,310,832 | 1/1982 | Fitzgerald | 340/815.12 |
| 4,333,084 | 6/1982 | Peterson | 346/17 |
| 4,509,046 | 4/1985 | Yamada | 340/815.12 |
| 4,564,845 | 1/1986 | Lambie | 346/17 |
| 4,675,654 | 6/1987 | Copeland | 340/461 |
| 4,727,353 | 2/1988 | Ruhter | 340/815.15 |
| 4,743,897 | 5/1988 | Perez | 340/762 |
| 4,748,454 | 5/1988 | Ikeda et al. | 346/17 |
| 4,890,088 | 12/1989 | Woodell | 340/461 |

*Primary Examiner*—Charles A. Ruehl
*Assistant Examiner*—Kinfe-Michael Negash

[57] ABSTRACT

A panel having an array of backlighted windows for displaying a change in a process variable from a nominal condition to a changed condition comprising a thin, sealed frame and a circuit board with an array of LEDs interconnected for each window and a binary switch coupled to the LED array that energizes the LEDs on receipt of a binary logic signal. The panel can be operated in a stand-alone unit or be backfitted to an existing data recorder, tapping into the incoming or internal logic variable signals and power supply without disturbing the underlying function of the recorder.

11 Claims, 3 Drawing Sheets

DIGITAL LOGIC WINDOW PANEL

BACKGROUND OF THE INVENTION

The present invention relates generally to lighted window alarms and annunciators and graphic panels.

Many industrial process variables are monitored electronically using thermocouples, transducers and other types of sensors that convert the value of the physical variable being sensed into a logic signal. The temperature and humidity of a computer room are physical variables, for example, and are vital to the proper functioning of computers in those rooms and must be closely monitored. In industry, variables may also include the status of equipment and its physical condition: turbine speed and eccentricity, acidity, pumps being turned on or off, production rates, pressure, etc. Natural conditions such as seismic events are monitored to gather data for the study of earthquakes. Lie detectors monitor the conductivity of the skin as an indirect measure of tension and stress during questioning. Building security systems sense the opening of doors and windows and the presence of excessive heat or smoke in a room or hallway. In these and many other examples, physical measurements are made and conveyed electronically to a receiver, which may passively record the measured data or may actively sound an alarm or light a light to alert the individuals responsible for monitoring the process, condition or event. The receivers of the measured data can be multipoint recorders, automatic controls, data loggers, scanners, controllers and so forth. Many of these devices use microprocessors for receiving and processing the data measurements.

While often physical variables can vary within a normal range without causing concern, it is important to know when a variable goes beyond this nominal range or when the status of equipment changes. Many systems now exist, such as annunciators, for providing this sort of information. However, many are based on relays, configured separately from the receivers and having substantial dimensions even when compactly designed. Many still use incandescent lights for illuminating warning signs, or, if LEDs are used for illumination, they only dimly light the signs. Incandescent lights have a relatively short operating life and are susceptible to failure in an environment where there are vibrations. Many of these units require separate power sources.

SUMMARY OF THE INVENTION

An object of the invention is to provide a lighted window alarm to indicate by illumination of the window that a process variable or other physical condition or item of equipment being monitored has changed to a predetermined condition from a nominal condition.

Another object of the invention is to provide a panel containing a series of independent windows each of which displays the condition of a separate monitored variable of a process or a condition of a piece of equipment simultaneously and continuously.

Another object of the invention is to provide a panel of lighted alarm windows that can be electronically attached to a multipoint recorder, data logger and other receivers of analog or digital logic signals, without the need for a separate power supply or additional wiring to sensors.

A still further object of the invention is to provide a thin, compact panel of lighted alarm windows that can be physically attached to a multipoint recorder, data logger and other receivers of analog or digital logic signals to monitor digital logic signals and provide a warning of a signal going outside the nominal range without the need for a stand alone unit, separate power supply or external wiring.

To achieve the foregoing and other objects and in accordance with the purpose of the invention, as embodied and broadly described herein, the invention comprises one or more window frames and associated electronic hardware for monitoring a digital logic signal present in or coming from an analog or digital logic receiver and for backlighting the window if the condition of the signal changes to a special condition from a nominal condition. The window frames are preferably arranged in a panel, with one or more panels grouped together as desired, each frame capable of backlighting with an array of LEDs a verbal or pictorial symbol carried by the window's surface.

In the preferred embodiment, the invention comprises a simple, rugged, inexpensive and replaceable attachment to a variety of analog or digital signal receivers, monitoring without disturbing the incoming or internal analog or logic signals, and drawing power from the receiver, providing a bright, easily-seen alerting signal when any of the monitored logic signals changes condition.

Reference is now made in detail to the present preferred embodiment of the invention, an example of which is given in the accompanying drawings.

BRIEF DESCRIPTION OF THE DRAWINGS

The accompanying drawings, which are incorporated in and form a part of the specification, illustrate the invention and, together with the description, serve to explain the principles of the invention. In the drawings.

DETAILED DESCRIPTION OF THE INVENTION

The present invention is an apparatus having electrical circuitry and one or more windows for determining and displaying by illumination a change in a logical variable from a nominal condition to a special condition. If more than one variable is to be displayed, the windows corresponding to each variable are preferably arranged in a panel. Where many variables are to be displayed or where there is a need for flexibility in adding windows from time to time, several panels may be used.

The panels may be used in a stand-alone configuration, for example, as a logic probe or a security system display, or may be physically and electronically attached to a receiver of analog or digital logic signals such as a data logger, multipoint recorder or programmable logic controller. The panel is compact enough to be attached to the inside of the front covers of multipoint recorders such as the "MOLYTEK 2702" recorder manufactured by Molytek, Inc. When attached to an existing receiver, the panel can draw power for its operation from the receiver and can monitor incoming or internally generalted logic signals without disturbing the operation of the underlying receiver.

Figure 1:
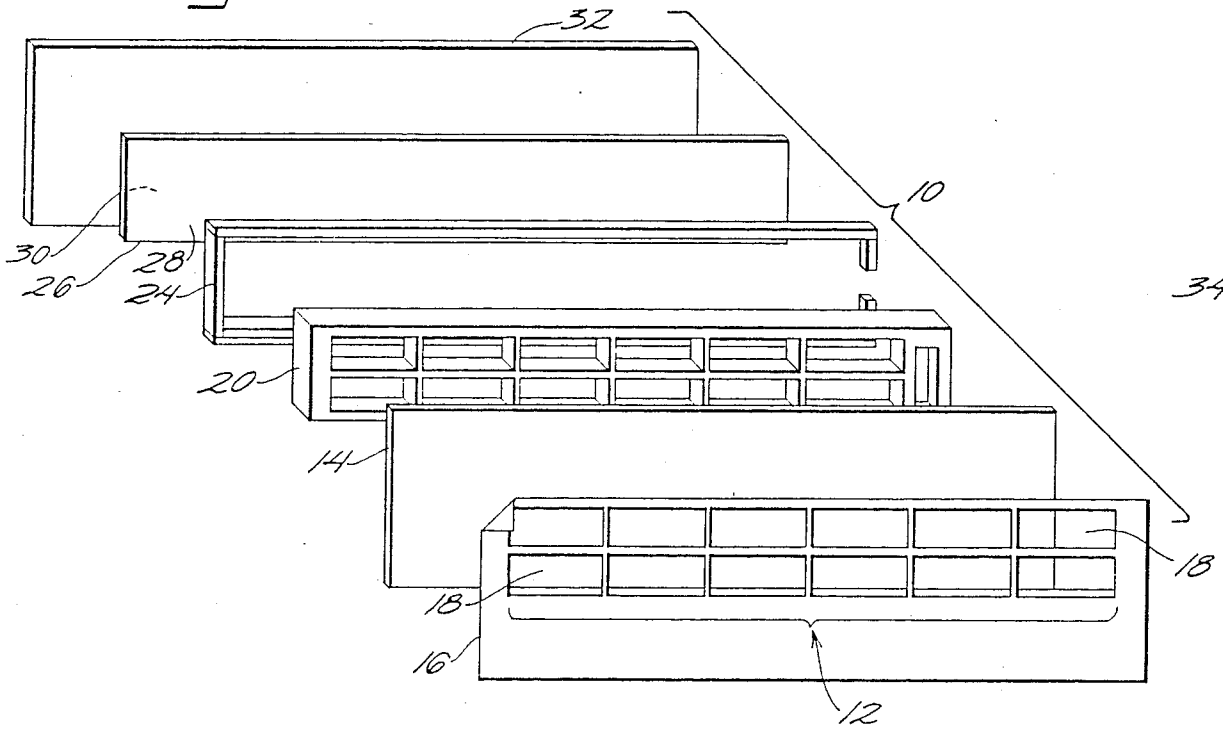
FIG. 1 is an exploded, perspective view of an embodiment of the window panel according to the present invention.

Referring now to FIG. 1, one embodiment of the digital logic window panel 10 having an array 12 of windows is shown in an exploded, perspective view. On the front panel 14 is a covering 16 having windows 18 corresponding to array 12. Covering 16 is preferably substantially opaque except at windows 18 and of a flexible, durable material such as 6 mil mylar silk-screened in black. Pictorial symbols or alphanumeric characters can be applied by silk-screening or other adhesive process to covering 16 at windows 18 to identify the logic variable corresponding to each window 18.

Behind front panel 14 is a window panel 20 defining the sides of array 12. Window panel 20 is also preferably substantially opaque, and most preferably made of a substantially opaque acrylic. Window panel 20 defines an opening 22 for receiving a logic cable to be described more fully below.

Surrounding window panel 20 is a spacer 24, also preferably made of acrylic. Adjacent to window panel and nested within spacer 24 is circuit board 26, with forward side 28 and reverse side 30. A back panel 32, preferably made of acrylic completes digital logic window panel 10.

Figure 2:
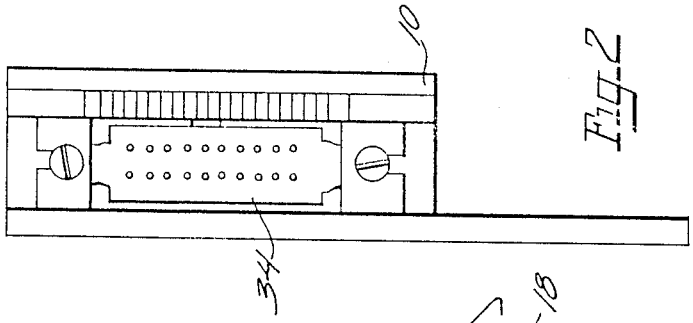
FIG. 2 is a side plan view of an embodiment of the window panel according to the present invention.

In FIG. 2, a view of the end of digital logic window panel 10 showing a cable receptacle 34 for a twelve window panel. Receptacle 34 receives a standard cable, preferably a flat cable such as a ribbon cable, bearing the electrical signals from the variables to be displayed. The remote end of the cable, not shown, will be chosen to plug into the source of the logic signals being monitored.

Figure 3A:
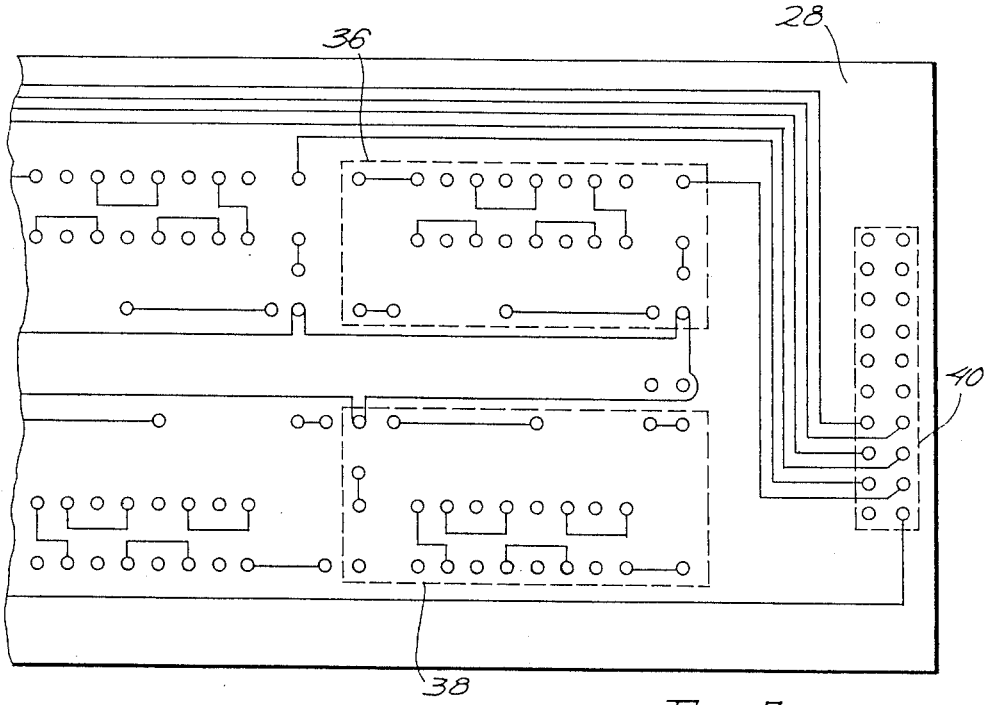
FIG. 3*a* is a partial view of the forward side of the printed circuit board having twelve windows in an embodiment of the present invention showing the circuitry of some of the windows, the others being equivalent.
Figure 3B:
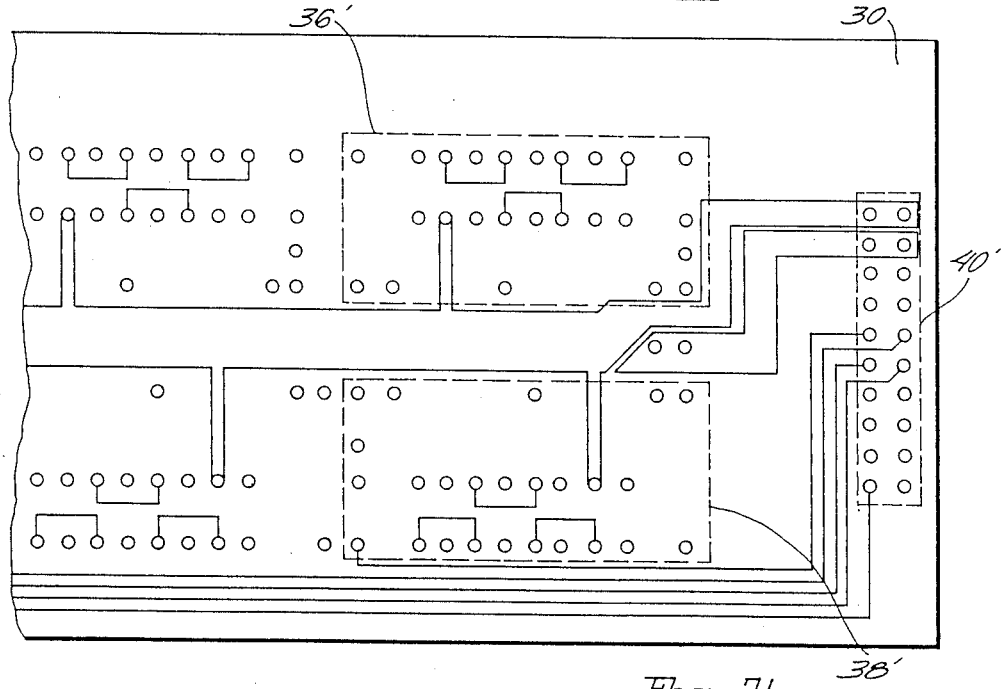
FIG. 3*b* is a partial view of the reverse side of the portion of the printed circuit board as would be seen through FIG. 3*a* according to an embodiment of the present invention.

FIGS. 3*a* and 3*b* show a portion of the circuit board for a twelve window panel. FIG. 3*a* shows forward side 28 of board 26; FIG. 3*b* shows reverse side 30 of board 26 through the forward side 28. A circuit board pattern 36 of terminals and conductors is repeated for each window. Circuit pattern 36 of FIG. 3*a* is equivalent to circuit pattern 38, for example, although reversed top to bottom and left to right. Circuit pattern 36' on FIG. 3*b* corresponds to pattern 36 on FIG. 3*a*. Receptacle 34 connects logic signals and power at pattern 39 and 39'.

Figure 4:
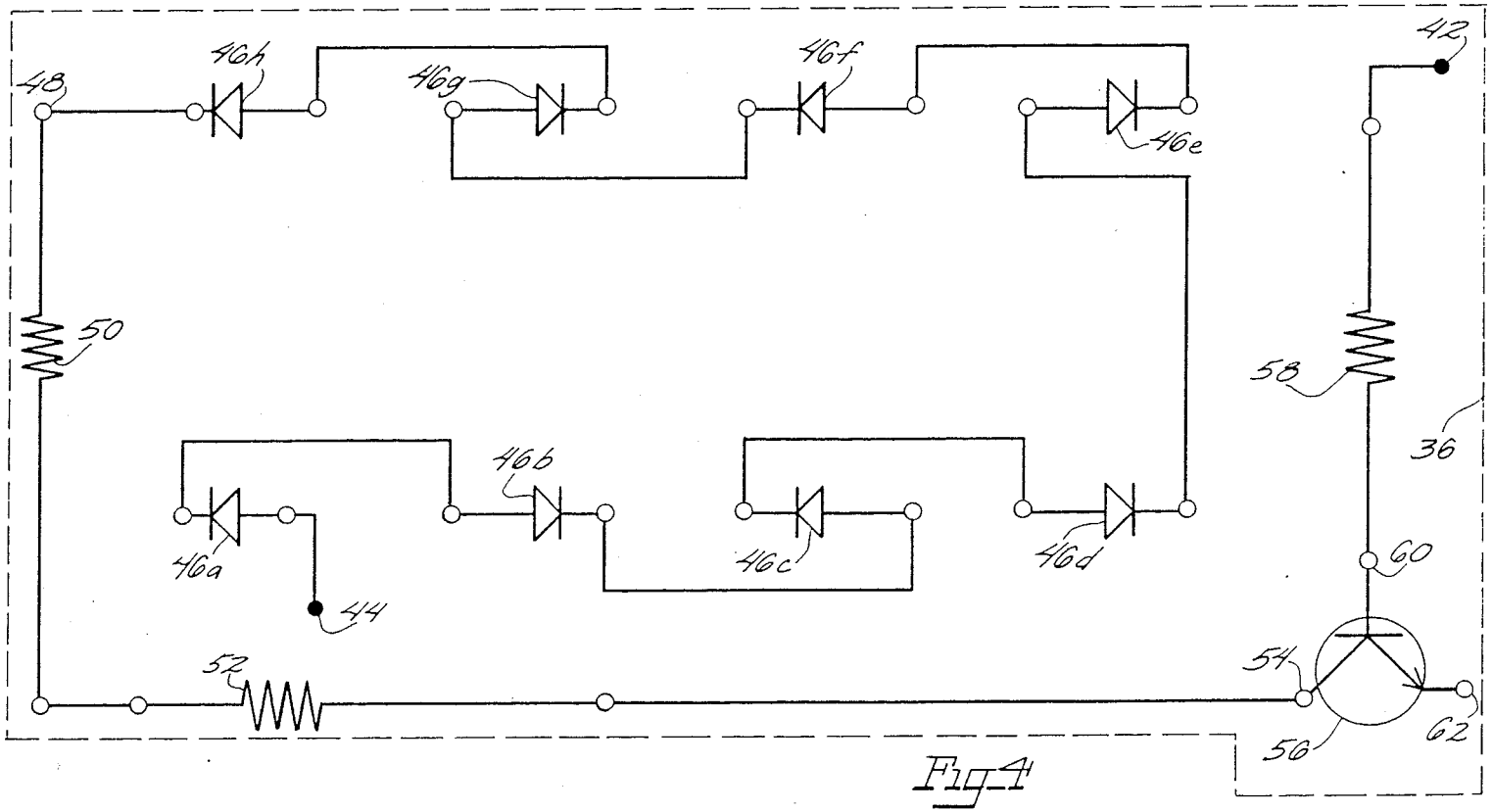
FIG. 4 is an electrical diagram of an embodiment of the circuitry for operating one of the windows according to the present invention.

Focussing on circuit pattern 36, as best seen in FIG. 4 where conducting paths on both sides of board 26 and circuit components are shown, a logic input signal is fed to terminal 42. The positive supply voltage applied at terminal 44 drives current through an array of eight light emitting diodes 46*a*, 46*b*, 46*c*, 46*d*, 46*e*, 46*f*, 46*g* and 46*h* (LEDs) before reaching terminal 48. The voltage is further dropped across resistors 50 and 52 before reaching the collector terminal 54 of transistor 56. Transistor is preferably an NPN for reasons of economy but the circuit could be made to operate on a PNP transistor or other binary switch with suitable adjustments to the circuitry as would be familiar to someone with expertise in the art.

The incoming logic signal "low" voltage drops from terminal 42 across resistor 58 and is fed to a base terminal 60 of transistor 56. As long as the voltage at base 60 is lower than the voltage at collector 54, indicating the variable being monitored is within the specified range, transistor 56 will be cut off and the array of LEDs 46 will not light. If the logic voltage goes high, indicating the variable being monitored has exceeded the specified range, the voltage at base 60 will rise above the voltage at emitter terminal 62, transistor 56 will saturate and array 46 will light.

The array of LEDs 46 create ample light for highlighting the fact that a variable being monitored has exceeded its normal range by backlighting a verbal or pictorial identifier on the corresponding window of panel 10. The use of LEDs and other surface mounted components on both sides of board 26 allows sufficient reduction in depth to enable the digital logic window panel 10 to be fitted within existing data recorders merely by connecting a cable from cable receptacle 34 directly to the logic signals, generated or received by the data recorder itself. Logic signals ranging from 2 to 29 volts can be accommodated. Panel 10 can also tap into the power supply of standard recorders for its power needs since it operates on a normal 24 to 30 volt supply. Because LEDs are used, there is very little heat generated by array 46, allowing window panel to be sealed to front panel and back panel, which reduces space requirements and light losses through leakage. In the embodiment described, the heat is essentially produced only by resistors 50, 52 and 58 which produce about one half watt total.

An equivalent circuit can he constructed from other binary switches and LEDs or other low wattage lighting sources such as liquid crystals which, although not backlighted and therefore not as easily seen in dim light as LEDs, have the advantage of being even more compact and therefore preferable for certain applications. Likewise, it will be clear that for automotive applications, based on a twelve volt power supply, the two drop resistors can be deleted along with two of the LEDs for each window of the panel to provide an equivalent function with still sufficient brightness. A minimum of four LEDs to a maximum of twelve is satisfactory for backlighting a window, depending on ambient lighting conditions in the environment of use.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A device for use with a data receiver for alerting that a logic variable associated with data processed by said data receiver has changed from a nominal condition to a special condition upon receipt by said device of an electrical signal responsive to the condition of said logic variable, said device comprising:

an array of at least four light-emitting diode in series for backlighting a word or symbol;

electronic circuitry means in operative connection with said array of light-emitting diodes and said data receiver, said circuitry means for energizing said array of light-emitting diodes when said logic variable changes to said special condition from said nominal condition and for deenergizing said array of light-emitting diodes when said logic variable changes to said nominal condition from said special condition, said circuitry means conducting when said logic variable is in said special condition but not conducting when said logic variable is in said nominal condition, said array backlighting said word or symbol when said circuitry means is conducting; and a sealed frame housing said circuitry means and said array of light-emitting diodes, said frame having a substantially opaque back, substantially opaque sides and a translucent cover through which cover said array of light-emitting diodes radiates light.

2. The device of claim 1 wherein said array of light emitting diodes comprises four to 12 light emitting diodes in series.

3. The device of claim 2, wherein said circuitry means further comprises a binary switch having an open position and a closed position, said switch changing to said closed position when said logic variable changes from said nominal condition to said special condition.

4. The device of claim 3 wherein said binary switch comprises a transistor.

5. The device of claim 1, wherein said circuitry means further comprises a binary switch having an open position and a closed position, said switch changing to said closed position when said logic variable changes from said nominal condition to said special condition.

6. The device of claim 5 wherein said binary switch comprises a transistor.

7. A device for use with a data receiver having a front cover, said data receiver processing data associated with a plurality of logic variables, said device for alerting that any of said plurality of logic variables generated by said data receiver has changed from a nominal condition to a special condition, said device comprising:

a plurality of arrays of light emitting diodes each of said arrays having at least four light-emitting diodes in series for backlighting a word or symbol, one of said arrays of light-emitting diodes corresponding to each logic variable of said plurality of logic variables;

a plurality of electronic circuitry means in operative connection with said data receiver, each of said electronic circuitry means in connection with said one of said arrays of light-emitting diodes, each of said plurality of circuitry means for energizing said array of light-emitting diodes when said corresponding logic variable changes to said special condition and for deenergizing said array of light-emitting diodes when said logic variable changes to said nominal condition, each of said circuitry means conducting when said corresponding logic variable is in said special condition but not conducting when said logic variable is in said nominal condition so that said array backlights said word or symbol when said corresponding logic variable is in said specified condition; and a sealed frame housing having a plurality of windows each of said windows having one of said circuitry means and one of said arrays of light-emitting diodes, said windows having substantially opaque backs, substantially opaque sides and translucent covers through which covers said arrays of light-emitting diodes can radiate light said frame dimensioned to fit within the dimensions of said front cover of said data receiver.

8. The device of claim 7, wherein said plurality of electronic circuitry means each further comprises a binary switch.

9. A device for alerting that conditions relating to said process variables have changed from nominal conditions to special conditions comprising:

a multipoint recorder receiving signals related to said process variables and generating at least one binary logic signal responsive thereto, said multipoint recorder having a front cover;

a frame having a plurality of windows, one of said windows for each binary logic signal, said frame attached to said multipoint recorder and each of said windows having a translucent front and substantially opaque sides and back, said frame dimensioned to fit within the front of said multipoint recorder;

a plurality of binary switches, one binary switch mounted within each of said windows, each of said switches having a closed position and an open position, each of said switches receiving one of said binary signals and switching position in response to changes in said condition relating to said process variables; and plurality of arrays of light-emitting diodes for backlighting said windows, one array of at least four light-emitting diodes in series for each of said windows and each array of light-emitting diodes in electrical connection with said binary switch, said array of light-emitting diodes lighting when said process variable changes to said special condition from said nominal condition.

10. The device of claim 9, wherein said array of light emitting diodes further comprises an array of four to twelve emitting diodes in series.

11. The device of claim 10, wherein said binary switch is a transistor.

* * * * *